US005539954A

United States Patent [19]

Ambar

[11] Patent Number: 5,539,954

[45] Date of Patent: Jul. 30, 1996

[54] ABUTMENT SWIVEL DOORSTOP

[76] Inventor: Neil Ambar, 211 Forrest Hill Road, Toronto, Ontario, Canada, M5P 2N3

[21] Appl. No.: 345,383

[22] Filed: Nov. 18, 1994

[51] Int. Cl.[6] ..... E05C 5/00; E05B 67/00

[52] U.S. Cl. ..... 16/85; 16/82; 292/67; 292/297; 292/290; 292/298; 292/205; 292/207

[58] Field of Search ..... 16/82, 85; 292/67, 292/297, 244, 205, 207, 290, 298

[56] References Cited

U.S. PATENT DOCUMENTS

| | | | |
|---|---|---|---|
| 2,794,663 | 6/1957 | Grodt et al. | 292/67 |
| 3,861,726 | 1/1975 | McLennan | 292/67 |
| 4,322,100 | 3/1982 | McLennan et al. | 292/67 |

*Primary Examiner*—Maurina I. Rachuba
*Assistant Examiner*—Adesh Bhargava
*Attorney, Agent, or Firm*—Imai, Jeffrey T.; Fors, Arne I.; Horne, D. Doak

[57] ABSTRACT

An abutment swivel doorstop has a mounting plate mountable onto a door frame, a stop member pivotally and slidably mounted on the mounting plate, a biasing means for urging the stop member in the disengaged position, a keeper pivotally mounted on the mounting plate, and a latch mountable on a door which is hingedly mounted within the door frame. The stop member is rotatable between a door opening position and a door blocking position and slidable between a disengaged and engaged position. The keeper is rotatable relative to the stop member between a locked and an unlocked condition. The keeper has a cam for urging the stop member against the biasing means and into the engaged condition as the keeper rotates between the locked and unlocked conditions. As the keeper rotates between the locked and unlocked conditions, the stop member engages and disengages the mounting plate and the latch for locking and unlocking the door to the door frame.

6 Claims, 3 Drawing Sheets

ABUTMENT SWIVEL DOORSTOP

FIELD OF INVENTION

This invention relates to an improved doorstop for preventing the opening of swinging doors.

BACKGROUND OF THE INVENTION

Conventional devices, such as a slide bolt, barrel bolt, door chain or interlocking levers, generally require only one or two serious blows before the device will fail allowing an intruder to break down the lock and enter. All of these devices provide a false sense of security to the occupant in that the occupant believes that the device will prevent intrusion when in fact only one or two serious blows are required to break down the lock.

Abutment swivel doorstops have been disclosed in U.S. Pat. No. Re. 29,162. This device uses a stop bar which is rotatable into a door blocking position by engagement of a rib and groove latch. Although novel, these doorstops did not attract any serious commercial success as the doorstop did not improve upon the security of the door beyond conventional devices. The device did not have sufficient strength to prevent an intruder from breaking the device.

Improvements were made to this particular doorstop and are more fully described in U.S. Pat. No. 4,322,100. Several improvements were made which addressed the strength problem. However, these improvements did not seriously increase the strength of the doorstop above other conventional security devices.

More recently, a device has come onto the market which is available from Winner Corporation and sold under the trademark DOORCLUB. Although this device exhibits improved strength characteristics in terms of withstanding numerous blows before failure, the device is large, bulky, expensive and requires sophisticated equipment for installation on the floor in front of the door. This installation requirement and size detracts from the salability of the product.

SUMMARY OF THE INVENTION

The disadvantages of the prior art may be overcome by providing an abutment swivel doorstop which allows a stop member to become registered with both a frame and a door upon rotating a single keeper.

According to one aspect of the invention, an abutment swivel doorstop has a mounting plate mountable onto a door frame, a stop member pivotally and slidably mounted on said mounting plate, a biasing means for urging the stop member to the disengaged position, a keeper pivotally mounted on the mounting plate, and a latch mountable on a door, the door being hingedly mounted within the door frame. The stop means is rotatable between a door opening position and a door blocking position and slidable between a disengaged and engaged position. The keeper is rotatable relative to the stop member between a locked and an unlocked condition. The keeper has a cam for urging the stop member against the biasing means and into the engaged condition as the keeper rotates between the locked and unlocked conditions. As the keeper rotates between the locked and unlocked conditions, the stop member engages and disengages the mounting plate and the latch for locking and unlocking the door to the door frame.

DESCRIPTION OF THE DRAWINGS

In drawing which illustrate the embodiment of the invention.

DESCRIPTION OF THE INVENTION

Figure 1:
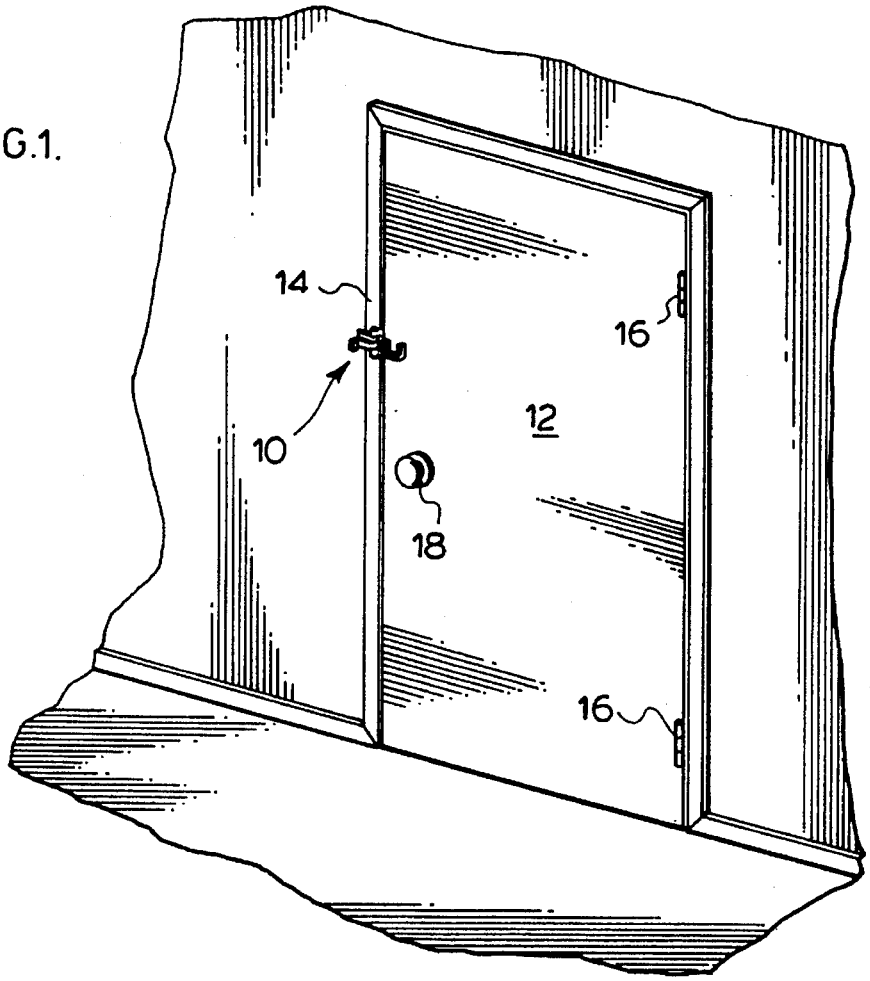
FIG. 1 is a perspective view of a door assembly incorporating the doorstop of the present invention.

The abutment swivel doorstop 10 of the present invention is generally illustrated in FIG. 1. The doorstop 10 is used in conjunction with a conventional door assembly comprising a door 12 mounted within frame 14 using hinges 16. Door 12 also has a door knob 18.

Figure 3:
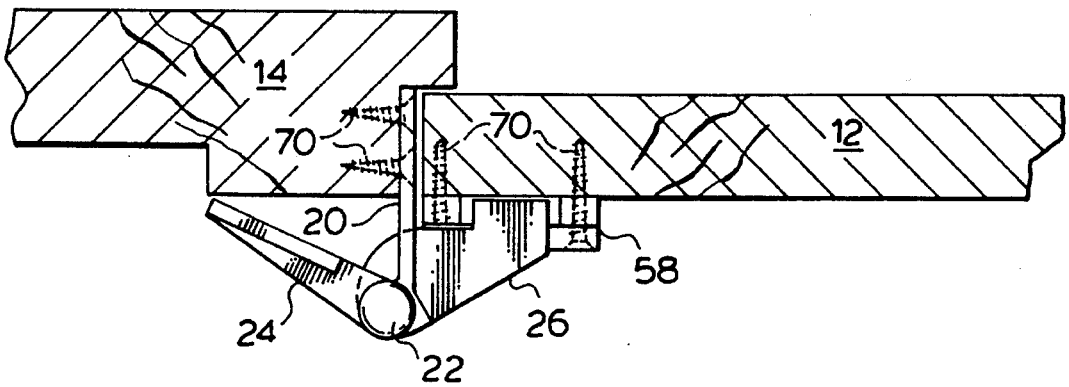
FIG. 3 is a top plan view of the invention of FIG. 1 illustrating the stop member in an engaged condition and the keeper in a locked condition.
Figure 4:
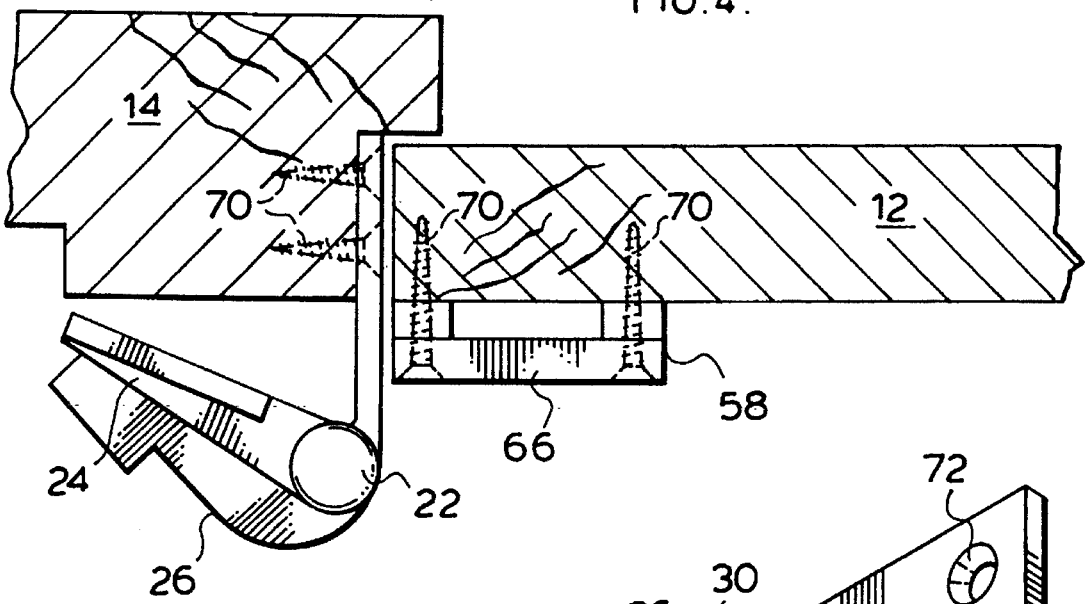
FIG. 4 is a top plan view of the invention of FIG. 1 illustrating the keeper and stop member in a door opening position.
Figure 5:
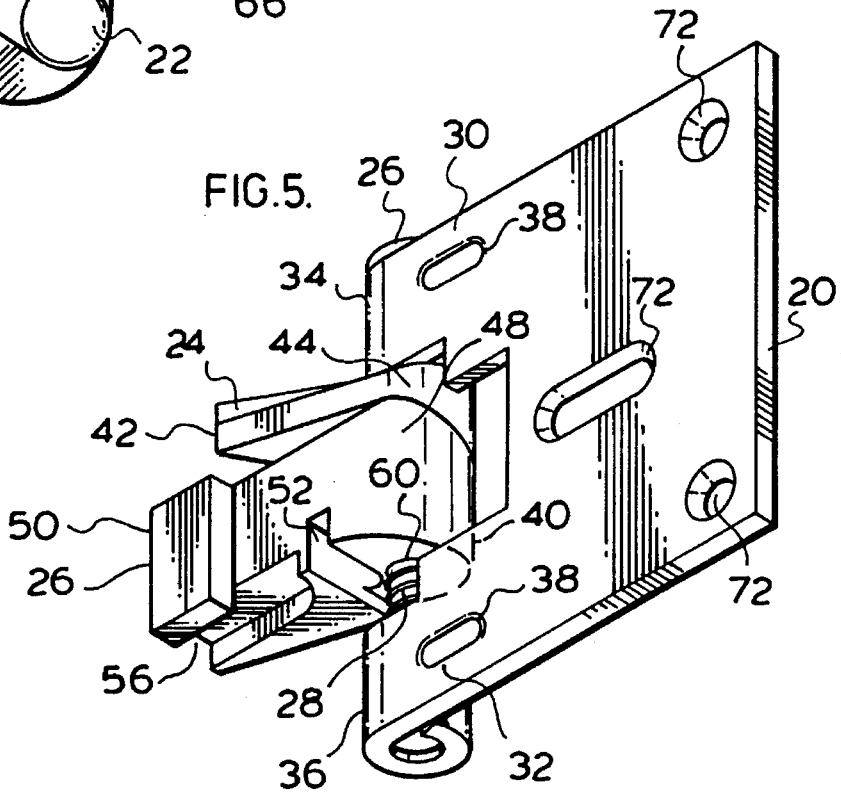
FIG. 5 is a perspective view of the portion of the invention of FIG. 1 which mounts on the door frame.
Figure 6:
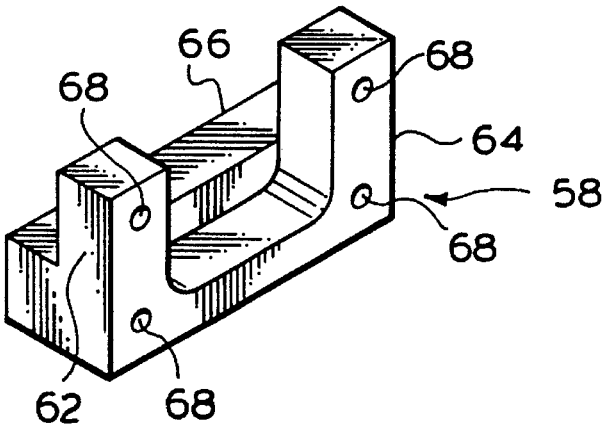
FIG. 6 is perspective view of the door latch of the invention of FIG. 1.
Figure 7:
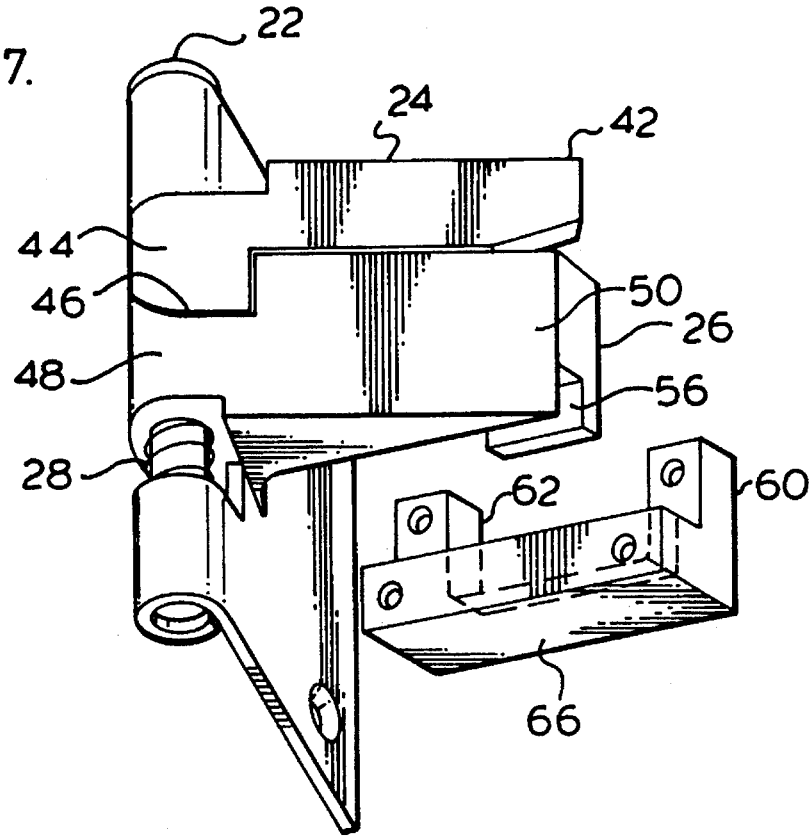
FIG. 7 is a perspective view of the invention of FIG. 1 illustrating the keeper in an unlocked condition and the stop member in a disengaged condition.

Referring to FIGS. 2–5, the doorstop 10 generally comprises a base plate 20, a pintle 22, a keeper 24, a stop member 26 and a torsional spring 28 (FIG. 5).

Base or mounting date plate 20 has an upper ear 30 and a lower ear 32 which are integral with the base plate 20 and extend from one edge thereof. Each remote end of upper ear 30 and lower ear 32 are cold rolled back over itself defining gudgeons 34 and 36. The remote ends of upper ear 30 and lower ear 32 are preferably welded back to itself to define gudgeons 34 and 36. Gudgeons 34 and 36 define a coaxial cylindrical channel through which pintle 22 extends.

In the region of the weld, upper ear 30 and lower ear 32 both have an embossment 38 stamped therein for improving the strength thereof. The upper edge of lower ear 32 is provided with a projection 40.

Keeper 24 has an arm 42 extending from a cylindrical core 44. Cylindrical core 44 has a central axially extending bore adapting the keeper 24 to be pivotally mounted on pintle 22. The central cylindrical core 44 has a cam surface 46 (FIG. 8) for extending the effective axial length of the cylindrical core 44.

Figure 8:
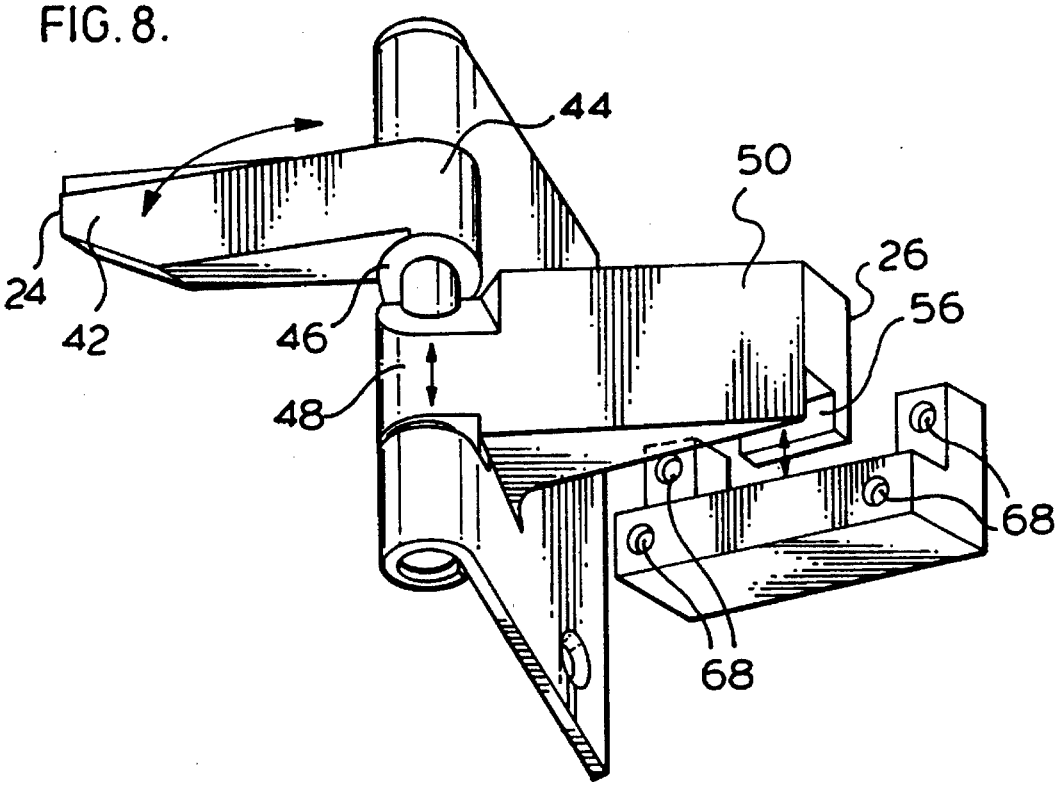
FIG. 8 is a perspective view of the invention of FIG. 1 illustrating the keeper moving to the locked condition and the stop member moving to the engaged condition.

Stop member 26 has a cylindrical core 48 and an abutment arm 50 extending therefrom. The lower surface of the abutment arm 50 has two grooves therein. Projection groove 52 radially extends from the centre of rotation and is positioned to engage projection 40 when the abutment swivel doorstop 10 is in a door blocking position (FIG. 1). The door groove 56 extends substantially perpendicular to projection groove 52. Door groove 56 will engage the door plate 58 when the abutment swivel doorstop 10 is in the locked position (FIGS. 3 and 8). The upper surface of the cylindrical core 48 is contoured to be complementary with the cam surface 46 of keeper 24. Cylindrical core 48 has a counterbore 60 adapted to receive torsion spring 28. Optionally, the upper surface of the cylindrical core 48 of stop member 26 has a detent for receiving the leading edge of cam surface 46 of keeper 24 when in a fully locked position.

Door plate or latch 58 comprises a pair of base footings 62 and 64 and a latch plate 66 extending thereacross. Base footings 62 and 64 are provided with bores 68 for receiving screws 70 or other fasteners for mounting onto the door 12. Once mounted, latch plate 66 is spaced from the planar surface of the door 12 (FIG. 4).

The doorstop 10 is assembled by aligning keeper 24 and stop member 26 in a complementary fit. Spring 28 is presented to counterbore 60 and compressed for placing between gudgeons 34 and 36. Pintle 22 is extended through gudgeon 34, keeper 24, stop member 26, spring 28 and gudgeon 36. Pintle 22 is permanently locked within the gudgeons 34 and 36 in any well known manner.

Figure 2:
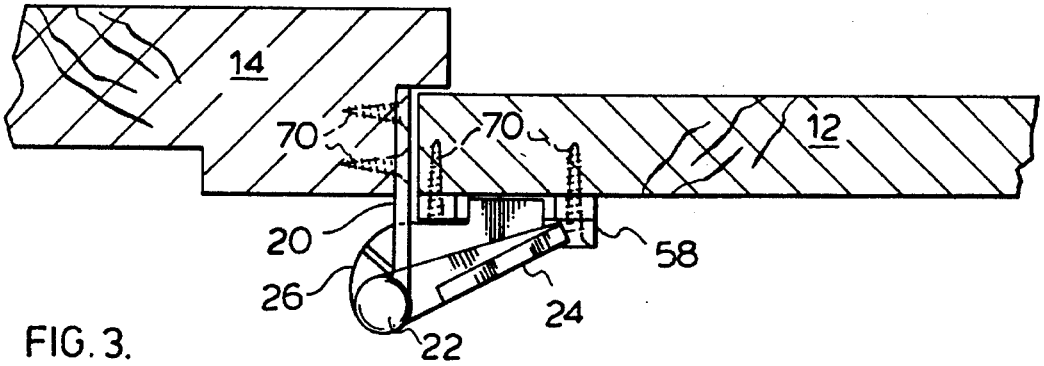
FIG. 2 is a top plan view of the invention of FIG. 1 illustrating a stop member and a keeper in a door blocking position.

Keeper 24 is rotatably mounted about pintle 22 between a locked and unlocked condition (FIG. 2 and 3, respectively). Spring 28 urges stop member 26 to engage keeper 24 in a complementary fit. Stop member 26 is also pivotally mounted for rotation about pintle 22. However, the spacing between gudgeons 34 and 36 allows sliding movement of stop member 26 along pintle 22 between an engaged and disengaged position.

When keeper 24 and stop member 26 are complementarily fitted together the keeper 24 and stop member 26 rotate about pintle 22 as a single unit between a door opening position (FIG. 4) to a door blocking position (FIG. 2).

When projection groove 52 is aligned to extend over projection 40, and keeper 24 is rotated relative to stop member 26 between an unlocked to a locked condition, cam surface 46 will urge stop member 26 downwardly such that projection groove 52 engages projection 40. Upon counter rotating keeper 24 relative to stop member 26, spring 28 urges the stop member 26 to disengage from projection 40, allowing free rotation of both the stop member 26 and keeper 24.

To install the doorstop 10 of the present invention, a recess corresponding to the general configuration of the base plate is cut or chiselled into the door frame 14. Screws 70 are inserted through apertures 72 to mount the base plate 20 onto the door frame. It is noted that the gudgeons 34 and 36, are directed away from the door 12 so as to not interfere with its swing.

Door plate 58 is mounted on the door immediately adjacent to the doorstop 10. The upper edge of latch plate 66 should be approximately level with projection 40.

As is apparent, the doorstop may be installed on both left-handed and right-handed doors merely by inverting the doorstop 10.

In use, the occupant closes the door 12. Keeper 24 and stop member 26 are rotated in unison into the door blocking position such that projection groove 52 aligns with projection 40 and door groove 56 aligns with latch plate 66. In this position, stop member 26 is in the path of the swing of the door 12. The stop member 26 is held in place while the keeper 24 is rotated relative thereto moving from the unlocked to the locked condition. As keeper 24 rotates relative to stop member 26, cam surface 46 urges stop member 26 downwardly to engage both projection 40 and latch plate 66. The keeper 24 is rotated until it contacts door frame 14. In this locked position, door 12 and door frame 14 are fully integrated.

To unlock, keeper 24 is counter rotated relative to the stop member 26 until keeper 24 and stop member 26 are aligned allowing stop member 26 to be urged upwardly by spring 28 for disengaging from projection 40 and latch plate 66. Once disengaged, keeper 24 and stop member 26 are free to rotate from the door blocking position to the door opening position out of the swing of door 12.

Preferably, base plate 20 is made from a sheet steel stamped and cold rolled. Keeper 24 and stop member 26 are preferably die cast. However, it is noted that stop member 26 is not hollowed as in previous devices.

Tests conducted on various models of the abutment swivel doorstop illustrate the apparent deficiencies in each earlier model. The doorstop according to U.S. Pat. No. Re. 29,162 deforms and disengages on the first hit at 33 foot pounds, providing a very minimal amount of security. An intruder could easily break this doorstop and enter.

The doorstop according to U.S. Pat. No. 4,322,100 was found to structurally deform upon the second hit at 33 foot pounds and disengage upon the seventh hit. Although an improvement of the holding ability, the security level was not superior to other blocking devices on the market.

The doorstop 10 of the present invention was observed to withstand 50 hits at 33 foot pounds without any deformation. The doorstop 10 further attained the highest level of testing standard, namely, ASTM Grade 40. The doorstop 10 was observed to not disengage and continued to hold even after the solid core wood door ruptured.

It is now apparent to a person skilled in the art that the abutment swivel doorstop of the present invention could be readily modified. It is understood that certain changes in components may be effective without departure from the spirit of the invention and within the scope of the appended claims.

I claim:

1. An abutment swivel doorstop comprising a mounting plate mountable onto a door frame, a stop member pivotally and slidably mounted on said mounting plate, said stop member slidable between a disengaged and engaged position, when in said disengaged position said stop member is rotatable between a door opening position and a door blocking position, a biasing means for urging said stop member to said disengaged position, a keeper pivotally mounted on the mounting plate, said keeper rotatable relative to said stop member between a locked and an unlocked condition, said keeper having a cam for urging said stop member against said biasing means and into said engaged condition as said keeper rotates between said locked and unlocked conditions, and a latch mountable on a door which is hingedly mounted within the door frame, wherein as said keeper rotates between said locked and unlocked conditions, said stop member engages and disengages said mounting plate and said latch for locking and unlocking said door to said door frame.

2. An abutment swivel doorstop as claimed in claim 1 wherein said stop member and said keeper are rotatably mounted on a common pintle.

3. An abutment swivel doorstop as claimed in claim 2 wherein said pintle engages at least two gudgeons formed in an end of said mounting plate.

4. An abutment swivel doorstop as claimed in claim 3 wherein said gudgeons are roll formed and welded to said mounting plate.

5. An abutment swivel doorstop as claimed in claim 4 wherein said mounting plate is stiffened in a region where said gudgeons are welded to said mounting plate.

6. An abutment swivel doorstop as claimed in claim 1 wherein said stop member has a detent for receiving said keeper when in said locked condition.

* * * * *